US008267017B1

(12) United States Patent
Michael et al.

(10) Patent No.: US 8,267,017 B1
(45) Date of Patent: Sep. 18, 2012

(54) FOLDING WORKBENCH

(76) Inventors: Daryl A. Michael, Newton, IA (US); Richard Allen Welsh, Robins, IA (US)

( * ) Notice: Subject to any disclaimer, the term of this patent is extended or adjusted under 35 U.S.C. 154(b) by 81 days.

(21) Appl. No.: 12/268,271

(22) Filed: Nov. 10, 2008

Related U.S. Application Data

(60) Provisional application No. 61/002,489, filed on Nov. 9, 2007.

(51) Int. Cl.
*A47B 3/00* (2006.01)

(52) U.S. Cl. ..... 108/42; 108/134; 248/240.4

(58) Field of Classification Search ..... 108/47, 108/48, 46, 152, 42, 143, 102, 134; 248/240.03, 248/240.3, 240.4, 235
See application file for complete search history.

(56) References Cited

U.S. PATENT DOCUMENTS

| | | | | | |
|---|---|---|---|---|---|
| 192,641 | A | * | 7/1877 | Durant et al. | 108/134 |
| 301,014 | A | * | 6/1884 | Shuler | 108/134 |
| 687,031 | A | * | 11/1901 | Jeffcoat | 108/81 |
| 1,284,512 | A | | 11/1918 | Werner | |
| 1,571,753 | A | * | 2/1926 | Christian | 108/47 |
| 1,576,034 | A | * | 3/1926 | Butt | 108/134 |
| 1,677,620 | A | * | 7/1928 | Cummings | 108/38 |
| 1,738,415 | A | * | 12/1929 | Wittlinger | 108/47 |
| 1,753,423 | A | * | 4/1930 | Kroschel | 108/37 |
| 2,483,899 | A | * | 10/1949 | Grasso et al. | 108/134 |
| 2,587,177 | A | | 2/1952 | Larson | |
| 2,743,976 | A | * | 5/1956 | Gaston | 108/134 |
| 2,943,896 | A | * | 7/1960 | Gaston | 108/134 |
| 3,113,533 | A | * | 12/1963 | Snow | 108/134 |
| 4,068,601 | A | * | 1/1978 | Marsh et al. | 108/134 |
| 4,736,689 | A | * | 4/1988 | Stanko | 108/143 |
| 4,844,398 | A | * | 7/1989 | Konkle | 248/240.4 |
| 4,927,107 | A | * | 5/1990 | Mateo Maria | 108/134 |
| 4,998,484 | A | | 3/1991 | Groetzinger | |
| 5,544,592 | A | * | 8/1996 | Leezer | 108/48 |
| 5,588,697 | A | * | 12/1996 | Yoshida et al. | 297/173 |
| 5,713,404 | A | | 2/1998 | Ladewig | |
| 6,039,416 | A | | 3/2000 | Lambert | |
| 6,161,486 | A | | 12/2000 | Boots | |
| 6,343,834 | B1 | * | 2/2002 | Wurmlinger | 297/14 |
| 6,705,235 | B1 | * | 3/2004 | Gerutto | 108/47 |
| 6,786,162 | B1 | | 9/2004 | Volkmer et al. | |
| 6,811,233 | B1 | | 11/2004 | Packer | |
| 6,978,721 | B2 | | 12/2005 | Myers | |
| 7,210,414 | B1 | * | 5/2007 | Barone | 108/42 |
| 7,464,652 | B2 | * | 12/2008 | Hauck | 108/48 |

* cited by examiner

*Primary Examiner* — Jose V Chen
(74) *Attorney, Agent, or Firm* — McKee, Voorhees & Sease, P.L.C.

(57) ABSTRACT

A folding workbench includes a work surface pivotally mounted to a wall for movement between a raised, horizontal use position and a lowered, vertical storage position. The workbench includes a pair of legs which are pivotally mounted at opposite ends to the wall and to the work surface. Each leg includes a knee joint. The legs are straight when the work surface is up and bent when the work surface is down. A lock prevents the legs from accidentally folding when the work surface is in the raised, use position.

22 Claims, 9 Drawing Sheets

FOLDING WORKBENCH

CROSS-REFERENCE TO RELATED APPLICATIONS

This application claims priority under 35 U.S.C. §119 of a provisional application Ser. No. 60/002,489 filed Nov. 9, 1997, which application is hereby incorporated by reference in its entirety.

BACKGROUND OF THE INVENTION

Folding workbenches for shops, garages, basements, and other locations are well known in the art. Prior art folding workbenches fold up or fold down from the horizontal work position to a vertical storage position. Often, a tool rack or peg board is provided upon the wall above the workbench to hold tools. Benches which fold upwardly cover the tools, which are then inaccessible, unless the bench is folded down. Both types of folding workbenches or tables typically include legs extending from the front edge of the work surface to the floor, which creates a footprint on the floor which must remain unobstructed. Some prior art folding workbenches include legs extending between the wall and the table. Some of these legs have to be disconnected from either the table or the wall before the table can be folded. Others include legs with complex joints or sliding components to accommodate folding action of the workbench or table top. Workbenches which fold down for storage are also subject to accidental folding due to instability of the legs. Both types of workbenches normally are lightweight, and not intended for heavy duty use.

Therefore, a primary objective of the present invention is the provision of an improved folding workbench.

Another objective of the present invention is the provision of a folding workbench which folds downwardly from the horizontal use position to a vertical storage position.

Another objective of the present invention is the provision of a folding workbench having legs extending from the wall to the front edge of the work surface.

Still another objective of the present invention is the provision of a folding workbench having a lock mechanism to prevent accidental folding of the workbench.

Yet another objective of the present invention is the provision of a folding workbench having legs with simple knee joints.

A further objective of the present invention is the provision of a folding workbench having support legs which do not engage the floor.

Still another objective of the present invention is the provision of a folding workbench having legs which are straight when the bench is in the use position and bent when the bench is in the storage position.

Yet another objective of the present invention is the provision of a folding workbench having legs which are pivotally connected to the bench top and to the wall both in the use position and in the storage position of the workbench.

A further objective of the present invention is the provision of a workbench which moves between a raised use position and a lowered storage position, and having legs which reside within the perimeter of the workbench in both positions.

A further objective of the present invention is the provision of a folding workbench which is economical to manufacture and durable and safe in use.

These and other objectives will become apparent from the following description of the invention.

BRIEF SUMMARY OF THE INVENTION

The folding workbench of the present invention is mounted to a wall above the floor and has jointed legs which extend between the table top or work surface and the wall. The table top moves between a raised, substantially horizontal work or use position extending outwardly from the wall and a lowered, substantially vertical storage position adjacent the wall. The legs are pivotally connected at opposite ends to the front edge of the work surface and to the wall and remain connected throughout movement of the table top between the use and storage positions. The legs do not engage the floor. The legs are straight when the table top is in the use position and bent when the table top is in the storage position. The legs do not extend beyond the perimeter edge of the table top in either the use or storage positions. A locking mechanism is provided to retain the table top in the use position and to prevent accidental folding of the workbench. The lock can be deactuated to disengage the legs to allow the workbench to fold downwardly from the use position to the storage position. The legs include upper and lower portions with a folding knee joint coupling the two portions together. The joint includes a slot in the lower end of the upper leg portion and a pin in the upper end of the lower portion, which is slidably received in the slot. A ramp on the lower portion is received in a notch or cutout in the upper portion and facilitates movement of the leg portions between the use and storage positions.

DETAILED DESCRIPTION OF THE PREFERRED EMBODIMENT

Figure 1:
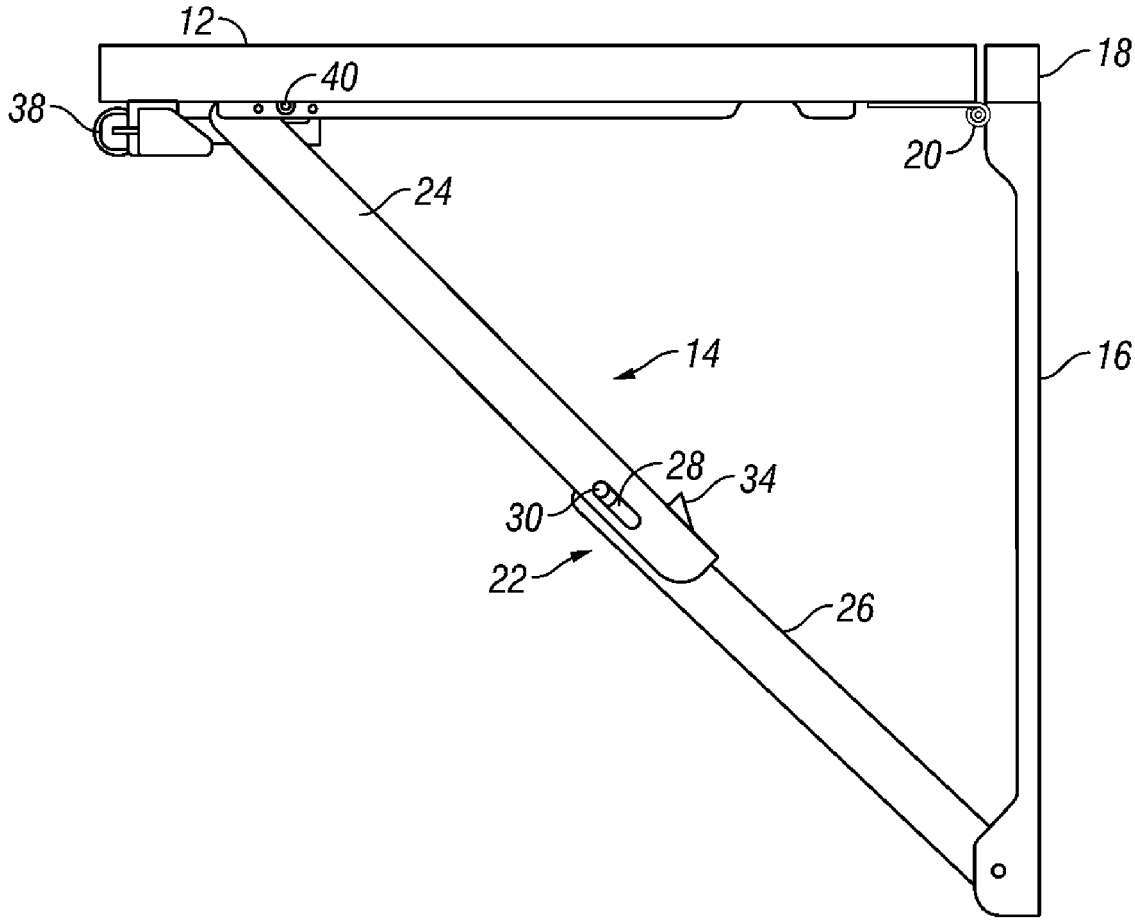
FIG. 1 is a side elevation view of the folding workbench of the present invention in the horizontal used position.

The folding workbench of the present invention is generally designed in the drawings by the reference numeral 10. The workbench 10 includes a table top or work surface 12, a pair of legs 14 and mounting brackets 16. The brackets 16 are secured to a wall in any convenient manner. A rear cross member 18 is attached to the tops of the mounting brackets 16 adjacent the wall. The table top 12 is connected to the cross member 18 by hinges 20, such that the rear edge of the bench top 12 is effectively pivotally secured to the wall but spaced a short distance from the wall, as seen in FIG. 1.

Figure 4:
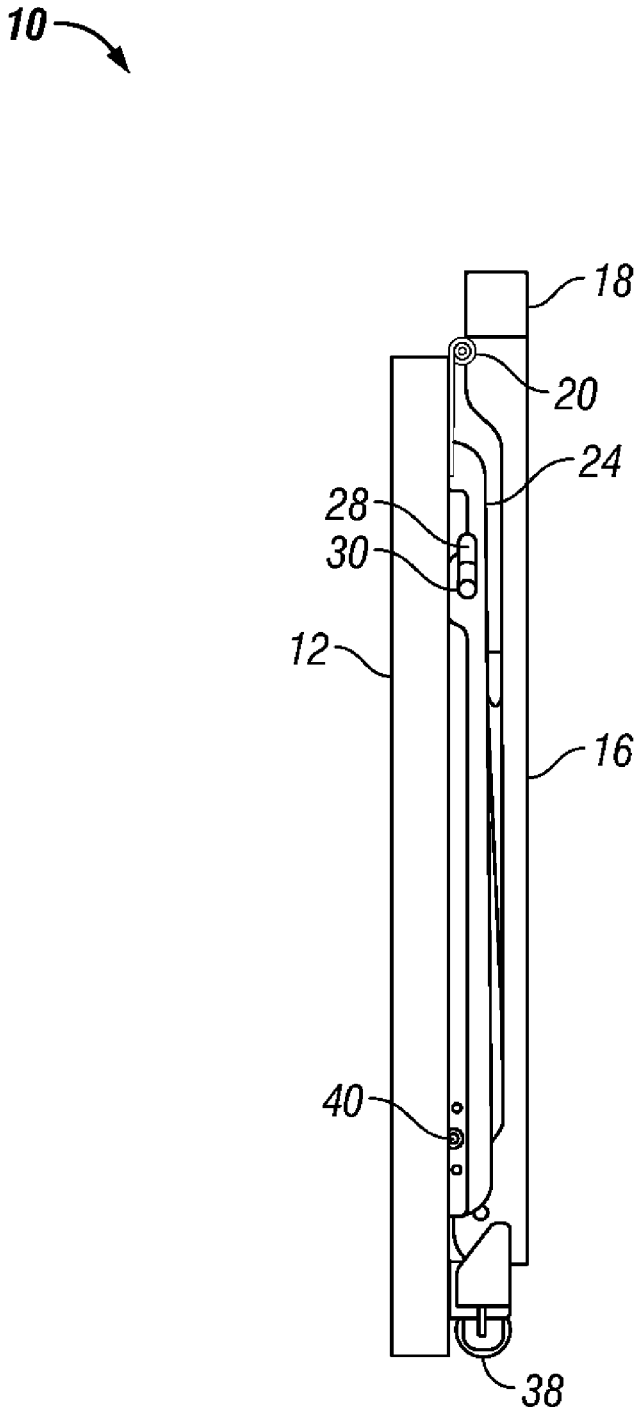
FIG. 4 is a view of the workbench in a fully folded vertical storage position.
Figure 5:
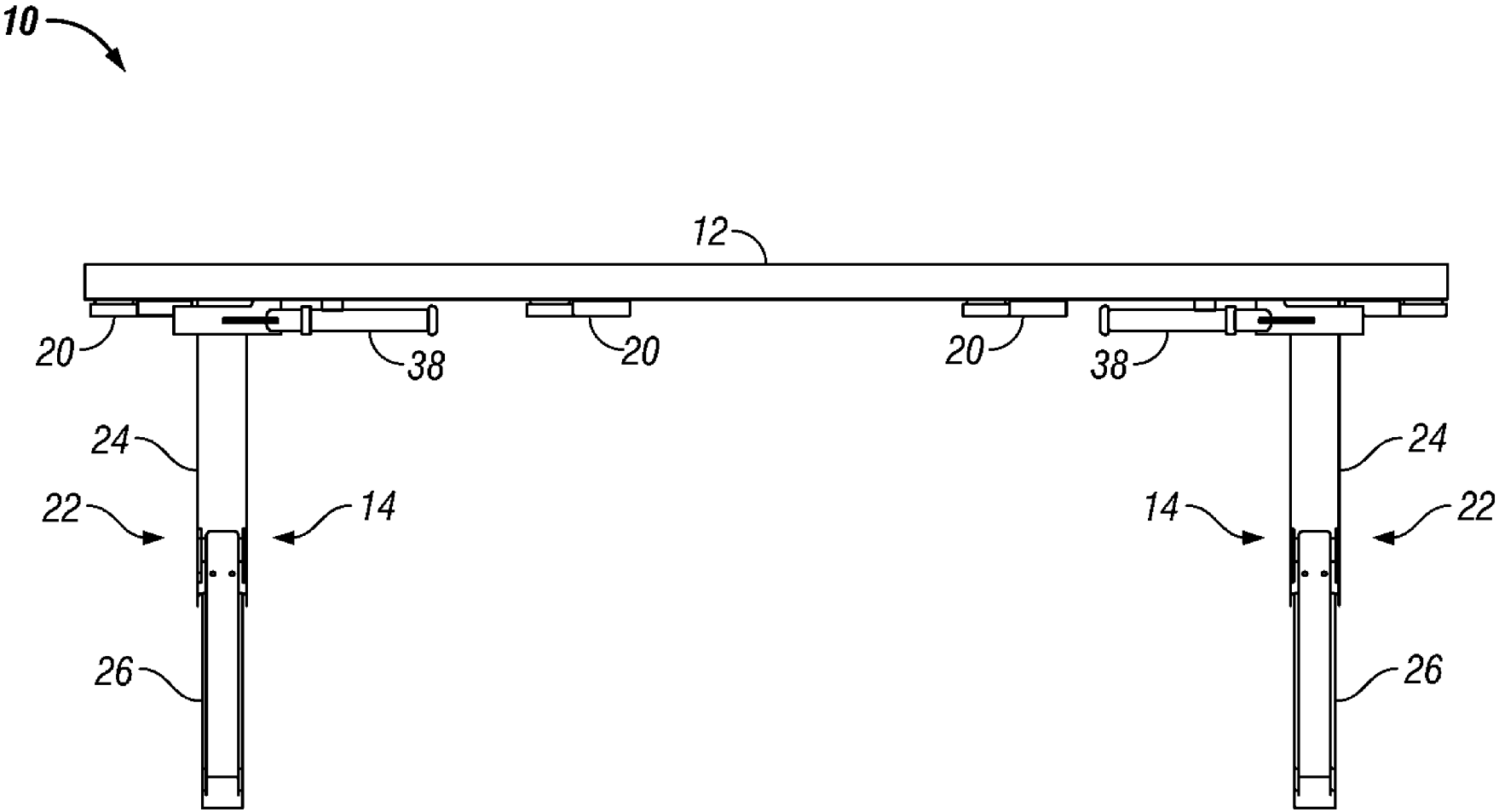
FIG. 5 is a front elevation view of the workbench in the raised horizontal use position.
Figure 6:
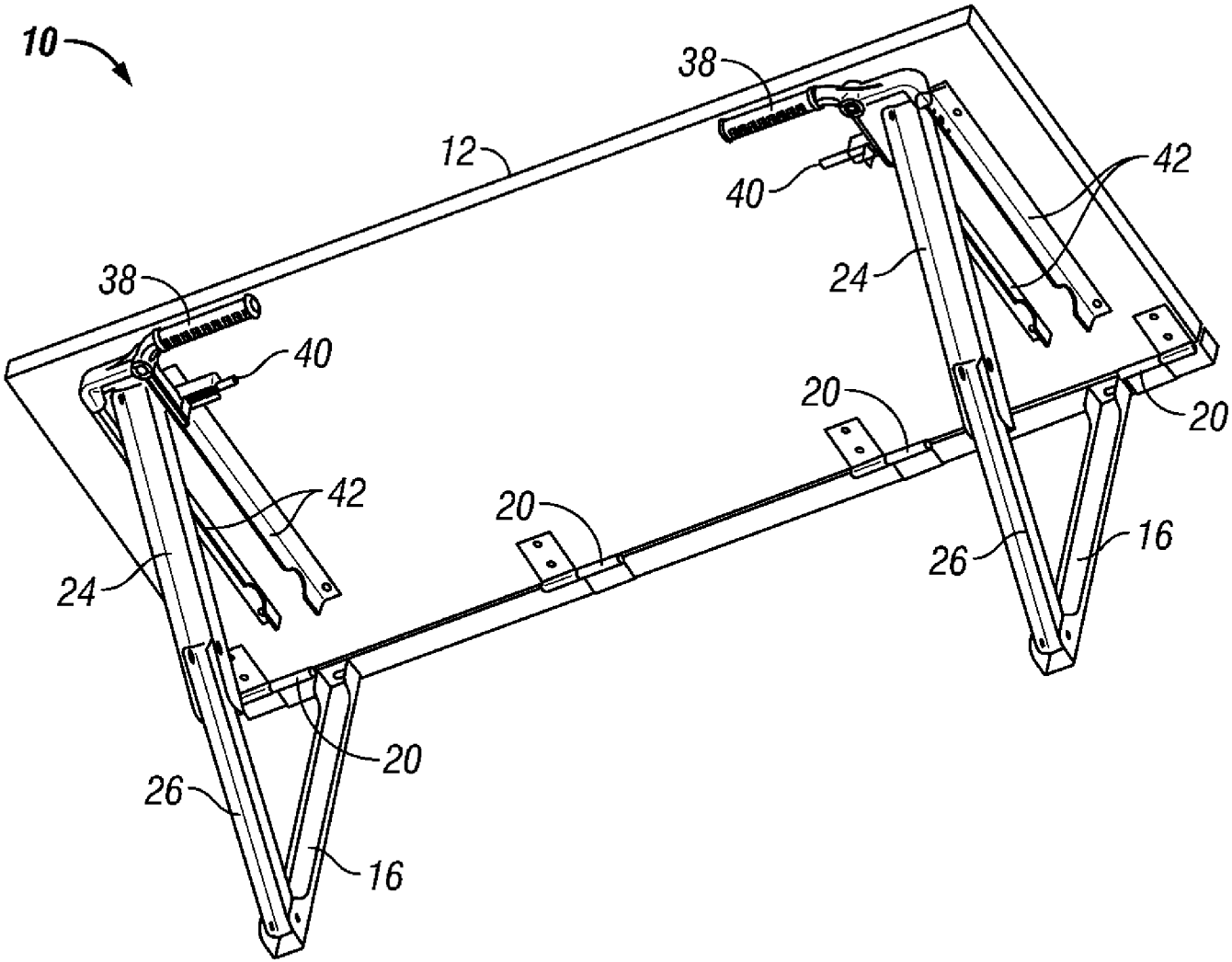
FIG. 6 is a bottom perspective view of the workbench in the raised used position.
Figure 9:
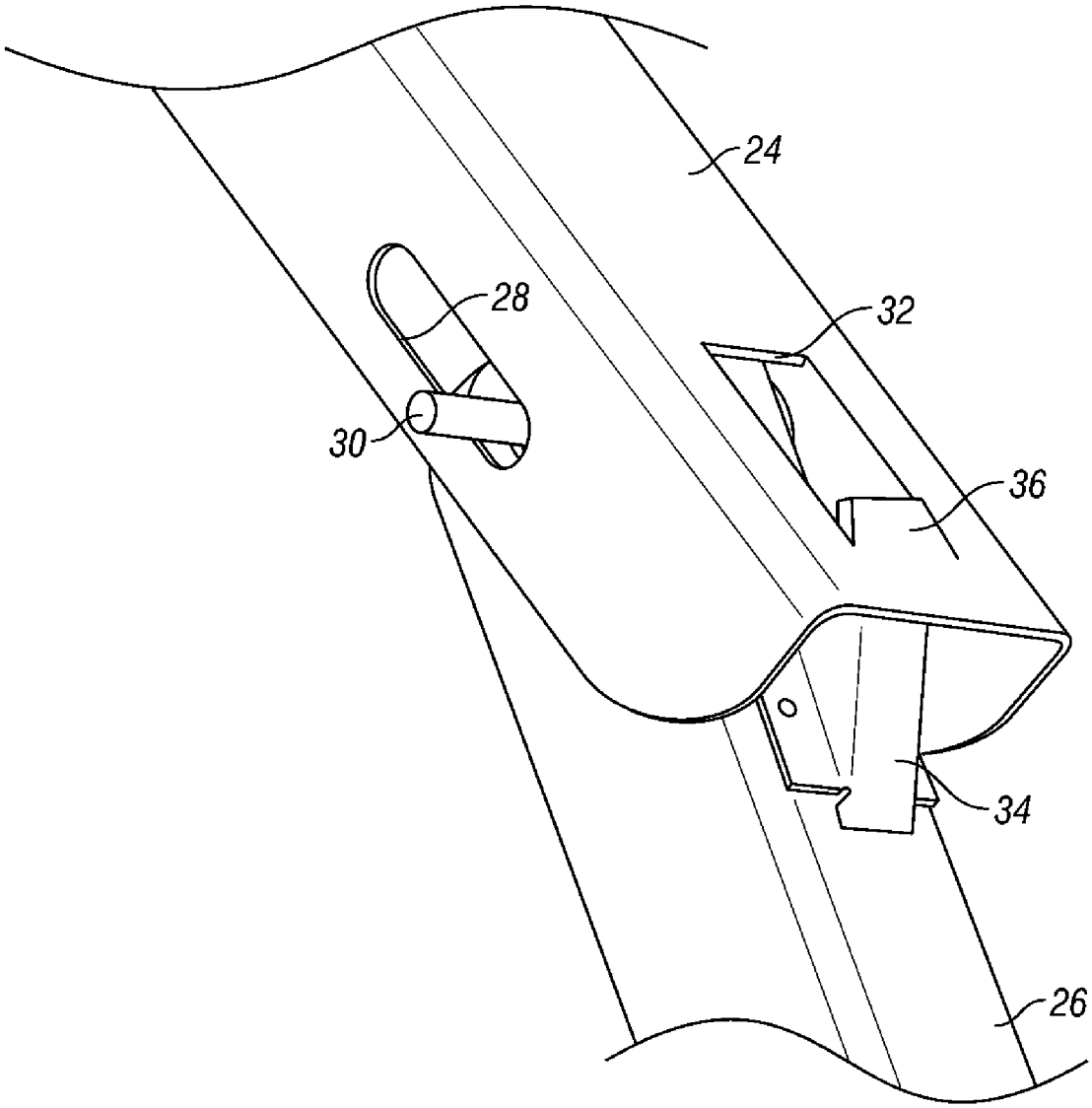
FIG. 9 is an enlarged perspective view of the knee joint of the workbench leg in a partially folded, unlocked position.

The table top 12 is moveable between a raised, substantially horizontal use position, as seen in FIG. 1, and a lowered, substantially vertical storage position, shown in FIG. 4. The legs 14 are preferably located near the opposite side or ends of the table top 12, and extend between the bottom of the mounting bracket 16 and a front edge of the table top 12. Each leg 14 includes a knee joint 22 to allow the table top 12 to fold up and down between the usage and storage positions. More particularly, each leg 14 includes upper and lower sections 24, 26. The front end of each upper section 24 is pivotally attached to the table top 12 adjacent the forward edge of table top 12 and the rear end of each lower section 26 is pivotally connected to the wall via the bracket 16. A slot 28 is provided in the upper leg section 24, with a pin 30 in the lower leg section 26 being slidably received in the slot 28. As best seen in FIG. 9, the upper leg section 24 also includes an opening or notch 32 adapted to receive a cam ramp 34 on the lower leg section 26. A tab 36 on the upper leg section 24 engages the cam ramp 34 to facilitate the movement of the knee joint 22.

Figure 2:
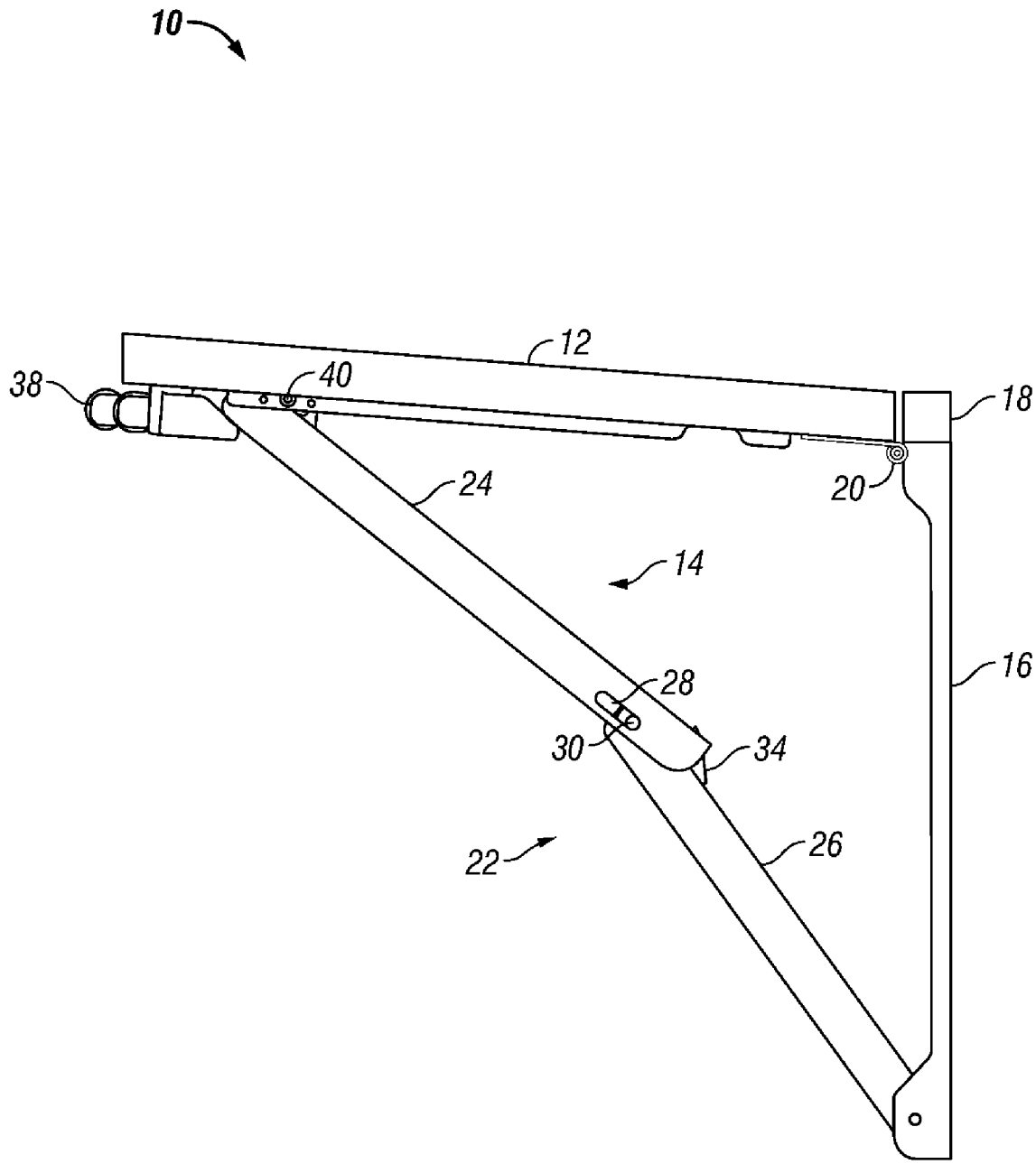
FIG. 2 is a side elevation view of the workbench showing a preliminary folding step wherein the work surface is raised slightly above a horizontal plane.
Figure 3:
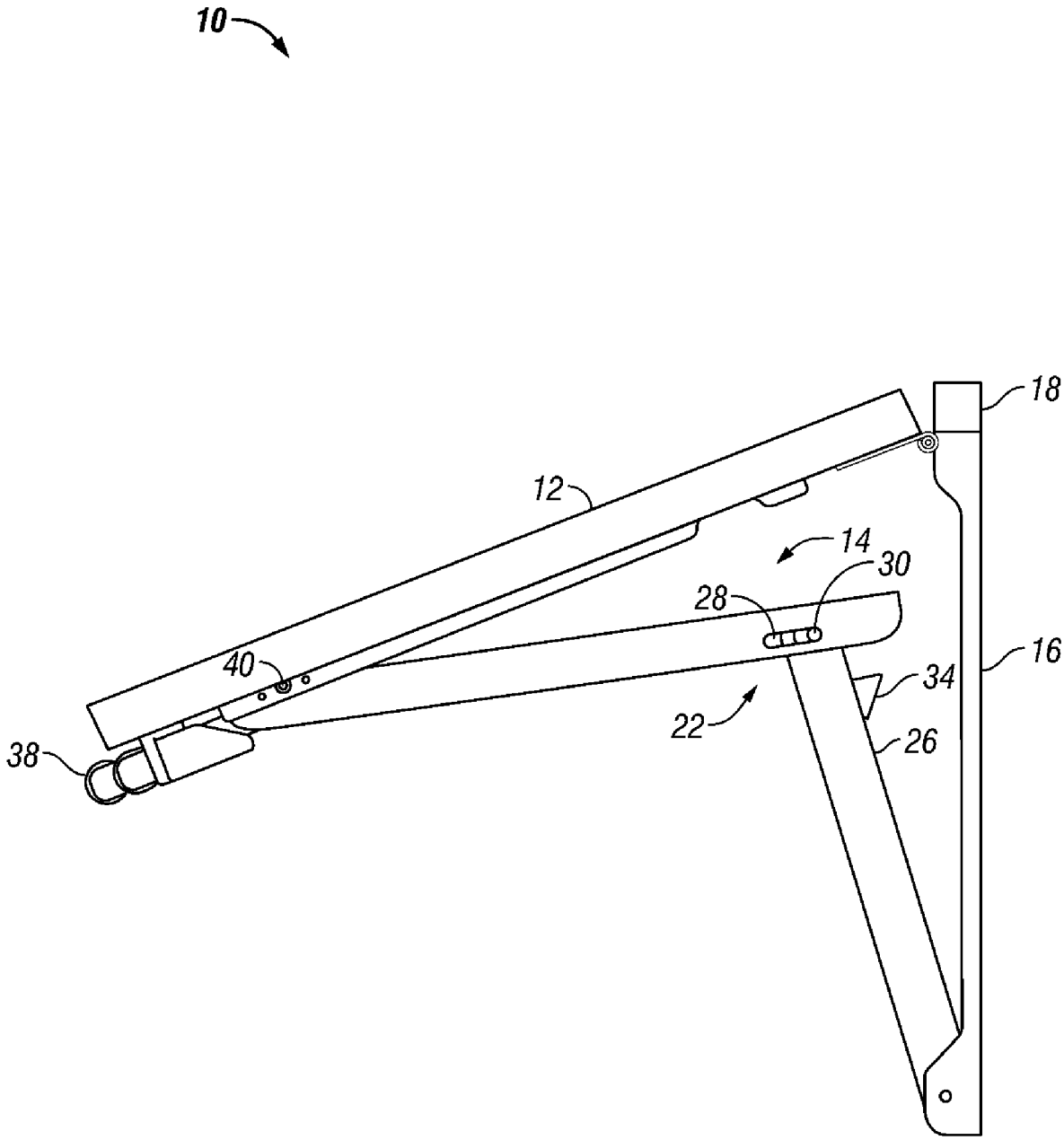
FIG. 3 is a side elevation view of the workbench in a partially folded position.
Figure 7:
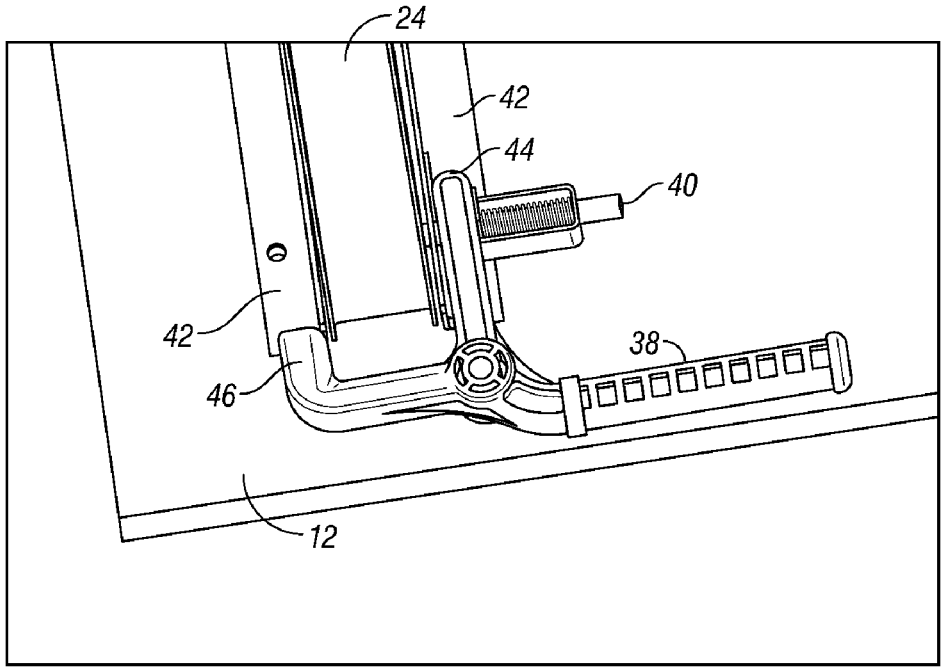
FIG. 7 is an enlarged bottom perspective view of the lock mechanism of the workbench in a locked position.
Figure 8:
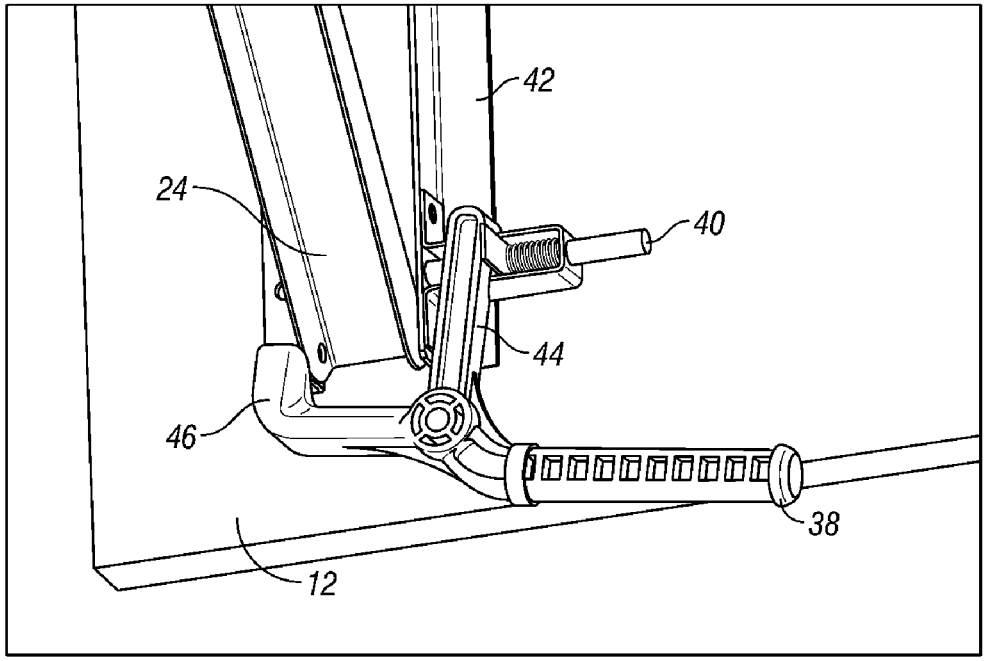
FIG. 8 is a bottom perspective view showing the lock mechanism in an unlocked or release position.

The workbench 10 also includes a lock mechanism comprising a pair of handles 38 which are pivotally mounted to the bottom of the table top 12 near the front edge for pivotal movement about a vertical axis between locked and unlocked or released positions. The lock mechanism also includes a spring-biased pin 40 extending through an aperture in a support bracket 42 on the bottom surface of the table top 12, and extending behind the upper leg section 24, when in the locked position shown in FIG. 7. The pin 40 prevents the upper leg section 24 from moving so that the knee joint 22 is locked in the straight-leg position when the table top 12 is in the use position. When it is desirable to lower the table top 12 to the storage position, the lock handles 38 are pulled forwardly so that a first arm 44 retracts the lock pin 40 from behind the upper leg section 24, as seen in FIG. 8, so that the upper leg section 24 is free to pivot relative to the table top 12. A second arm 46 on the handles 38 frictionally engages the upper leg section 24 to momentarily prevent the leg from folding, while the table top 12 is lifted slightly above the horizontal, as seen in FIG. 2. This lifting of the table top 12 causes the cam ramp 34 to disengage from the tab 36, thereby allowing the knee joint 22 to fold or buckle rearwardly, so that the table top 12 can be moved to the substantially vertical storage position adjacent the wall, as seen in FIG. 4. As seen in FIG. 1, when the table top 12 is in the use position, the pin 30 of the lower leg section 26 is adjacent the upper end of the slot 28 of the upper leg section 24. When the table top 12 is in the storage position, the pin 30 is adjacent the lower or rear end of the slot 28.

In an alternative embodiment, the cam ramp 34 and tab 36 can be eliminated, with the folding of the knee joint 22 being controlled solely by the pin 34 of the lower leg section 26 sliding in the slot 28 of the upper leg section 24.

It is noted that the legs 14 reside behind or below the table top 12 in both the use and storage positions. When the table top 12 is up, as shown in FIG. 1, the legs 14 are straight, and when the table top 12 is down, the legs 14 are bent, without extending beyond the perimeter edge of the table top 12, as seen in FIG. 4. In the storage position, the legs 14 are folded substantially vertically against the wall within the mounting brackets 16, with the table top 12 fully covering the legs 14.

It is also understood that other types of locking mechanisms can be provided to retain the table top in the raised use position and preclude the table top 12 from accidentally folding down to the storage position. Such alternatives may include a pin extending through the upper and lower leg sections 24, 26 at the knee joint 22, or any other convenient means for preventing accidental buckling of the knee joint 22.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A folding workbench mounted to a wall above a floor, comprising:

a work surface pivotally moveable between a raised, substantially horizontal work position and a lowered, substantially vertical storage position;

a pair of legs having opposite lower and upper ends extending between the wail and the work surface, respectively, for supporting the work surface in the raised position without engaging the floor;

a pair of locks mounted to the work surface adjacent a front edge of the work surface moveable between a lock position engaging the legs to retain the work surface in the work position and an unlock position disengaging the legs to allow the work surface to be moved to the storage position; and each lock including a pin to engage and disengage the upper end of one of the legs to control pivotal movement of the work surface.

2. The folding workbench of claim 1 wherein each leg includes a knee joint.

3. The folding workbench of claim 2 wherein each knee joint folds towards the wall when the work surface is moved to the storage position.

4. The folding workbench of claim 2 wherein each leg includes upper and lower sections and the joint includes a slot in one section and a pin in the other section slidably received in the slot.

5. The folding workbench of claim 1 wherein the work surface has a perimeter edge, and the legs do not extend beyond the perimeter edge in either the use or storage positions.

6. The folding workbench of claim 1 wherein the legs are pivotally connected to the work surface and to the wail in both the use and storage positions.

7. The folding workbench of claim 1 wherein each lock includes a handle pivotally mounted on the work surface to move the pin between engaged and disengaged positions upon pivotal movement of the handle.

8. A folding workbench, comprising:

a table top having a perimeter edge including a rear edge pivotally connected adjacent a wall, a front edge, and opposite side edges;

a pair of legs each having a lower end pivotally connected adjacent the wall and an upper end pivotally connected adjacent the front edge of the table top;

the table top being foldable between a raised use position and a lowered storage position adjacent the wall;

a pair of handles connected to the table top and being moveable for selectively locking and unlocking the upper ends of the legs to control folding of the table top; and, a pair of pins slidabley moveable by actuation of the handles between a first position engaging the legs to retain the table top in the use position and a second position disengaged from the legs to allow the table top to fold downwardly to the storage position.

9. The folding workbench of claim 8 wherein the legs each have pivotal knee joints, and the handles control pivoting movement of the knee joints.

10. The folding workbench of claim 9 wherein the knee joints move rearwardly when the table top is folded down to the storage position.

11. The folding workbench of claim 8 wherein the legs remain attached to the table top and to the wall while the table top moves between the use and storage positions.

12. The folding workbench of claim 8 further comprising a lock engaging at least one leg to retain the table top in the use position and disengaging the one leg to allow the table top to fold down to the storage position.

13. The folding workbench of claim 8 wherein the table top has upper and lower surfaces, and further comprising a pair of brackets mounted on the lower surface, with the upper ends of the legs pivotally connected to the brackets, and movement of the handles slidably moving the pins through the brackets to engage and disengage the upper ends of the legs.

14. The folding workbench of claim 1 wherein the work surface has opposite top and bottom sides, and further comprising a bracket mounted to the bottom side of the work surface, and the lock pin extends through the bracket to block the leg against pivotal movement.

15. A folding workbench comprising:

a table top pivotally connected to a wall for movement between a raised use position and a lowered storage position;

a pair of legs each having a lower rearward end pivotally connected to the wall and an upper front end pivotally connected to the table top in both the use and storage positions;

a joint in each leg whereby the leg is straight when the table top is in the use position and bent when the table top is in the storage position;

a releasable lock engaging the legs when the table top is in the use position; and the lock including a pair of pins adjacent the upper front ends of the legs and moveable between a locked position engaging the front ends of the legs to preclude folding of the legs and an unlocked position disengaging the front ends of the legs to allow folding of the legs.

16. The folding workbench of claim 15 wherein the legs reside behind a perimeter edge of the table top in both the use and storage positions.

17. The folding workbench of claim 15 wherein the legs are attached to the table top and to the wall throughout movement of the table top between storage and use positions.

18. The folding workbench of claim 15 wherein each leg includes upper and lower sections and the joint includes a slot in one section and a pin in the other section slidably received in the slot.

19. The folding workbench of claim 15 further comprising a pair of handles to move the pins from the locked position to the unlocked position.

20. The folding workbench of claim 15 wherein the pins are biased to the locked position.

21. A folding workbench, comprising:

a table top having a perimeter edge including a rear edge pivotally connected adjacent a wall, a front edge, and opposite side edges;

a pair of legs each having a lower end pivotally connected adjacent the wall and an upper end pivotally connected adjacent the front edge of the table top;

the table top being foldable between a raised use position and a lowered storage position adjacent the wall;

a pair of handles connected to the table top and being moveable for selectively locking and unlocking the upper ends of the legs to control folding of the table top; and a pair of brackets on a bottom surface of the table top, and a pair of pins, one of the pins slidably mounted in each bracket for movement by the handles to engage and disengage the legs to control folding action of the table top.

22. A folding workbench comprising:

a table top pivotally connected to a wall for movement between a raised use position and a lowered storage position;

a pair of legs each having a lower rearward end pivotally connected to the wall and an upper from end pivotally connected to the table top in both the use and storage positions;

a joint in each leg whereby the leg is straight when the table top is in the use position and bent when the table top is in the storage position;

a pair of pins adjacent the upper front ends of the legs and moveable between a locked position engaging the front ends of the legs to preclude folding of the legs and an unlocked position disengaging the front ends of the legs to allow folding of the legs; and the table top having upper and lower surfaces; and brackets on the lower surface for pivotally receiving the upper ends of the legs, and the pins being manually slidable through the brackets to engage and disengage the front ends of the legs.

* * * * *